US012798918B2

(12) United States Patent
Kao et al.

(10) Patent No.: US 12,798,918 B2
(45) Date of Patent: Nov. 17, 2026

(54) PORTABLE HOOK AND LOOP STRIP DISPENSER

(71) Applicant: JETOOL CORP., New Taipei City (TW)

(72) Inventors: Yi Ching Kao, New Taipei City (TW); Chien-Hung Chou, New Taipei City (TW)

(73) Assignee: JETOOL CORP., New Taipei City (TW)

( * ) Notice: Subject to any disclaimer, the term of this patent is extended or adjusted under 35 U.S.C. 154(b) by 73 days.

(21) Appl. No.: 19/045,528

(22) Filed: Feb. 4, 2025

(65) Prior Publication Data

US 2026/0021993 A1 Jan. 22, 2026

(30) Foreign Application Priority Data

Jul. 19, 2024 (TW) ..... 113127064

(51) Int. Cl.
*B65H 35/06* (2006.01)

(52) U.S. Cl.
CPC ..... *B65H 35/06* (2013.01); *B65H 2405/45* (2013.01); *B65H 2405/575* (2013.01); *B65H 2701/37* (2013.01)

(58) Field of Classification Search
CPC ..... B65H 35/06; B65H 2405/45; B65H 2405/575; B65H 2701/37
USPC ..... 221/30, 32, 42, 154, 282, 289, 296, 303; 222/80, 129, 160, 167
See application file for complete search history.

(56) References Cited

U.S. PATENT DOCUMENTS

2022/0411221 A1* 12/2022 Alpan ..... B65H 35/002

FOREIGN PATENT DOCUMENTS

| | | |
|---|---|---|
| JP | 2001087011 | 4/2001 |
| TW | 200837369 | 9/2008 |

* cited by examiner

*Primary Examiner* — Justin V Lewis
(74) *Attorney, Agent, or Firm* — JCIPRNET

(57) ABSTRACT

A portable hook and loop strip dispenser includes a base, a movable claw, a button, and a spring. The base has a protrusion column and a stopper block disposed in the protrusion column, in which a roll portion of the hook and loop strip is sleeved onto the protrusion column. The movable claw is liftably disposed in the protrusion column, and a claw hook of the movable claw is extended out of the protrusion column or retracted into the protrusion column along with the movable claw lifting or lowering in the protrusion column. The button is rotably and liftably disposed on the protrusion column and borne on the movable claw, and the button is in a locked state or an unlocked state due to rotation. The spring abuts between the protrusion column and the movable claw and constantly drives the movable claw to lift in the protrusion column.

10 Claims, 12 Drawing Sheets

PORTABLE HOOK AND LOOP STRIP DISPENSER

CROSS-REFERENCE TO RELATED APPLICATION

This application claims the priority benefit of Taiwan application serial no. 113127064, filed on Jul. 19, 2024. The entirety of the above-mentioned patent application is hereby incorporated by reference herein and made a part of this specification.

BACKGROUND

Technical Field

The disclosure relates to a dispenser, and in particular to a portable hook and loop strip dispenser.

Description of Related Art

Hook and loop fasteners, also known as touch fasteners, are a kind of fiber fasteners, which are usually formed by two pieces of fabric, one surface is covered with a loop-like structure, and the other surface is covered with a hook-like structure. When the two pieces of fabric are pressed together, the hook and loop combine to form a temporary fastening state. If it is desired to separate the two pieces, it is only needed to use force to separate.

Hook and loop fasteners may be used in a variety of ways with a high degree of freedom, and are widely used in outdoor products, such as backpacks, tents, safety equipment, sportswear, sports shoes to provide adjustment, fixation, and restraint to target objects.

In actual use, the hook and loop fastener is mostly presented in the form of raw materials such as stacked sheets or rolled strips (ribbons). Users need to additionally prepare cutting tools such as scissors to cut into required sizes. However, this operation not friendly to all usage environments. For example, when performing interior decoration or cable wiring, operators have to move to different deployment locations, which also means that if the hook and loop fastener is presented in the above-mentioned form of raw materials, the operators inevitably have to move with the raw materials, which significantly reduces convenience and causes burdens to the operators.

SUMMARY

The disclosure provides a portable hook and loop strip dispenser, which allows the hook and loop strip to be carried thereon in a rolled state, thereby facilitating portable carrying for a user.

The portable hook and loop strip dispenser according to an embodiment of the disclosure includes a base, a movable claw, a button, and a spring. The base has a protrusion column and a stopper block disposed in the protrusion column, and the roll portion of the hook and loop strip is sleeved onto the protrusion column. The movable claw is liftably disposed in the protrusion column, and a claw hook of the movable claw is extended out of the protrusion column or retracted into the protrusion column along with the movable claw lifting or lowering in the protrusion column. The button is rotatably and liftably disposed on the protrusion column and borne on the movable claw. The button is in a locked state or an unlocked state due to rotation. The spring abuts between the protrusion column and the movable claw, and constantly drives the movable claw to lift in the protrusion column. In the locked state, the stopper block blocks a lowering path of the button, and the claw hook of the movable claw is extended out of the protrusion column to stop and limit the roll portion at the protrusion column. The movable claw is driven by the spring to abut the button against the protrusion column. In the unlocked state, the stopper block moves away from the lowering path of the button. The button is adapted to be pressed to drive the movable claw to lower in the protrusion column to deform the spring. The claw hook of the movable claw is retracted into the protrusion column to release the roll portion.

Based on the above, the dispenser is disposed with the protrusion column on the base thereof that can accommodate the roll portion of the hook and loop strip, and is disposed with the movable claw, the button, and the spring on the protrusion column together. Accordingly, the protrusion column may not only be used for the roll portion to be sleeved thereon, but also can stop, hold, or release the roll portion through the claw hook of the movable claw, so that when the roll portion is held by the claw hook, the hook and loop strip is firmly disposed on the base and does not fall from the dispenser during portable carrying of the user.

DESCRIPTION OF THE EMBODIMENTS

Figure 1:
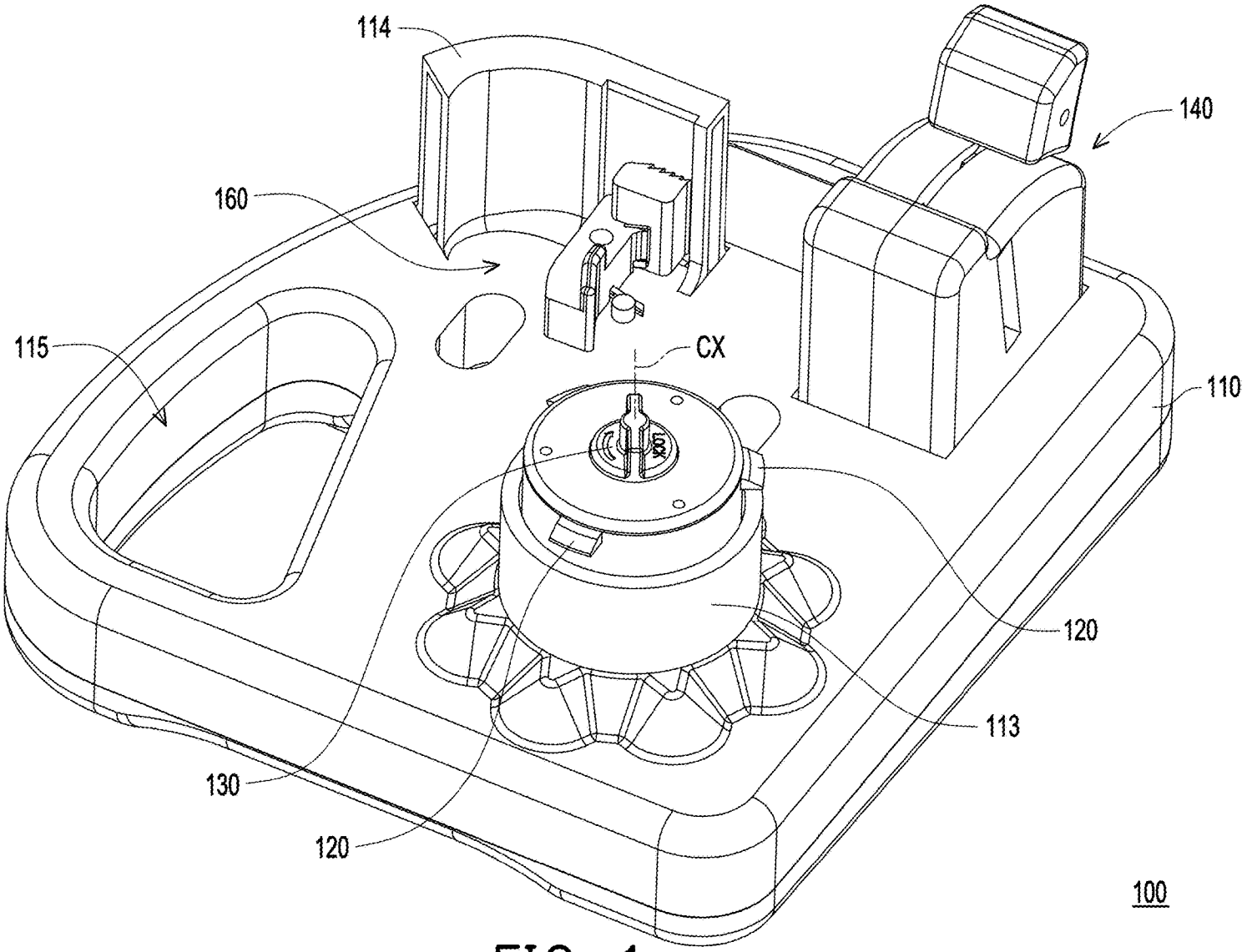
FIG. 1 and FIG. 2 respectively illustrate schematic views of a portable hook and loop strip dispenser according to an embodiment of the disclosure from different viewing angles.
Figure 2:
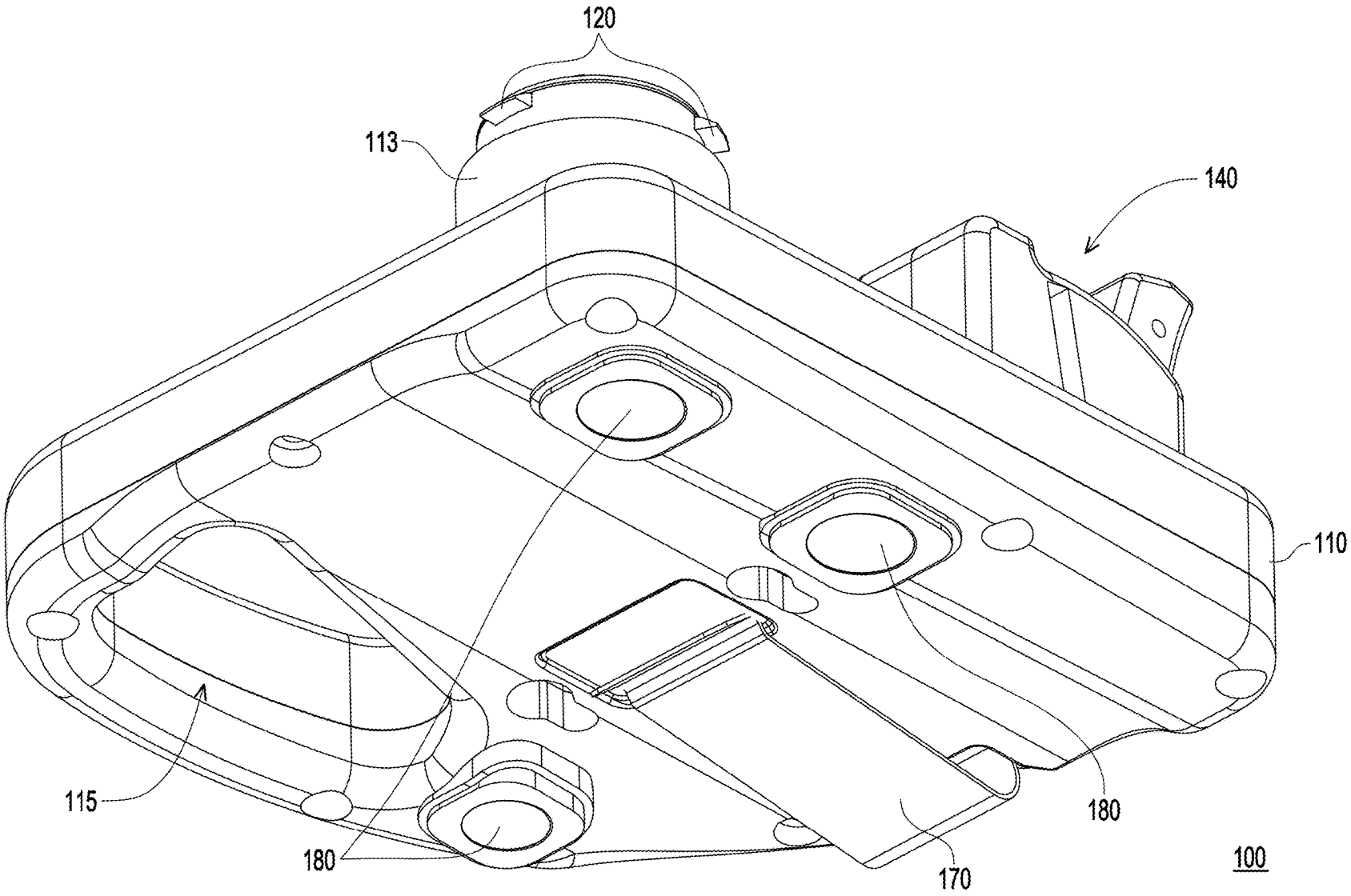
Figure 3:
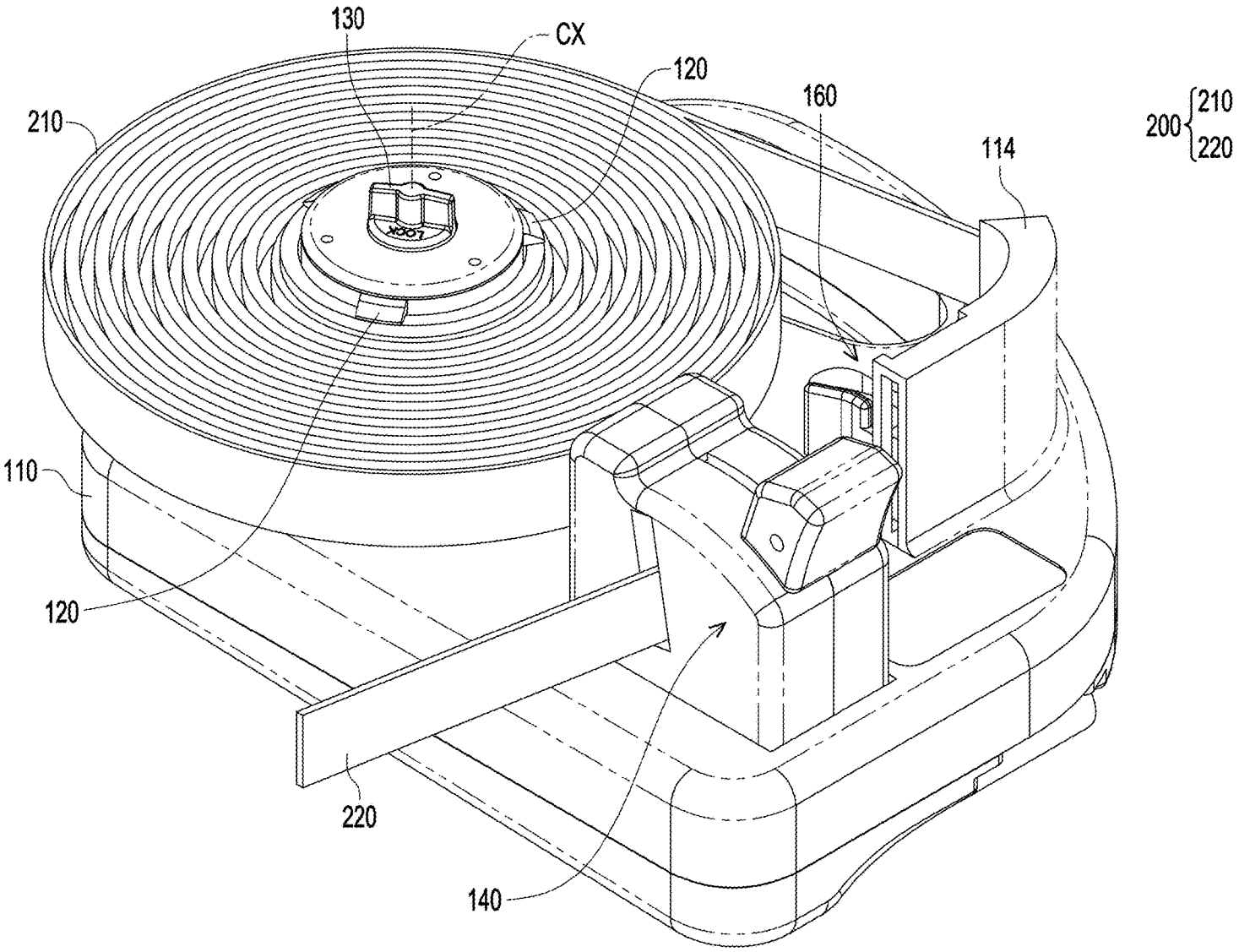
FIG. 3 is a schematic view of the portable hook and loop strip dispenser in use.

FIG. 1 and FIG. 2 respectively illustrate schematic views of a portable hook and loop strip dispenser according to an embodiment of the disclosure from different viewing angles. FIG. 3 is a schematic view of the portable hook and loop strip dispenser in use. Please refer to FIG. 1 to FIG. 3 at the same time. In this embodiment, a portable hook and loop strip dispenser 100 (hereinafter referred to as the dispenser 100) provides a hook and loop strip 200 carried thereon in a rolled state, as shown in FIG. 3. The dispenser 100 includes a base 110 and a protrusion column 113 thereon. A roll portion 210 of the hook and loop strip 200 is sleeved on the protrusion column 113 and is further held by a movable claw 120 to be fixed on the base 110. When the user carries the base 110, the hook and loop strip 200 does not fall off.

Figure 4A:
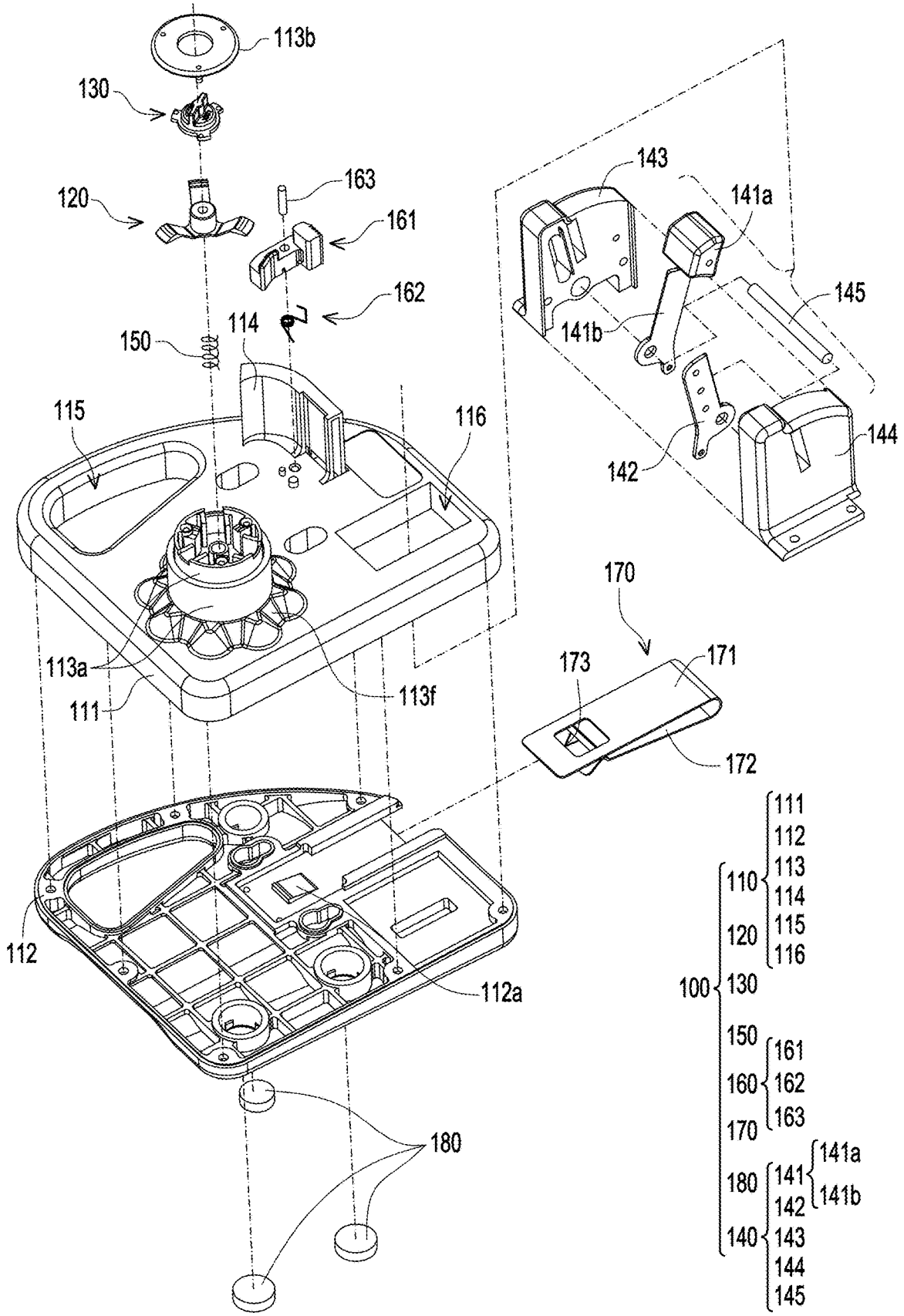
FIG. 4A is an exploded view of the portable hook and loop strip dispenser.

FIG. 4A is an exploded view of the portable hook and loop strip dispenser. Please refer to FIG. 4A. In this embodiment, the dispenser 100 includes the movable claw 120, a button 130, a spring 150, and the base 110. The base 110 is formed by an upper shell 111 and a lower shell 112, and a protrusion column 113 extends and protrudes from the upper shell 111. The movable claw 120 is liftably disposed in the protrusion column 113, and a claw hook 122 of the movable claw 120 is extended out of the protrusion column 113 or is retracted into the protrusion column 113 along with the movable claw 120 lifting or lowering in the protrusion column 113. Furthermore, the protruding column 113 has a slope 113*f* to facilitate the roll portion 210 to bear thereon.

Figure 4B:
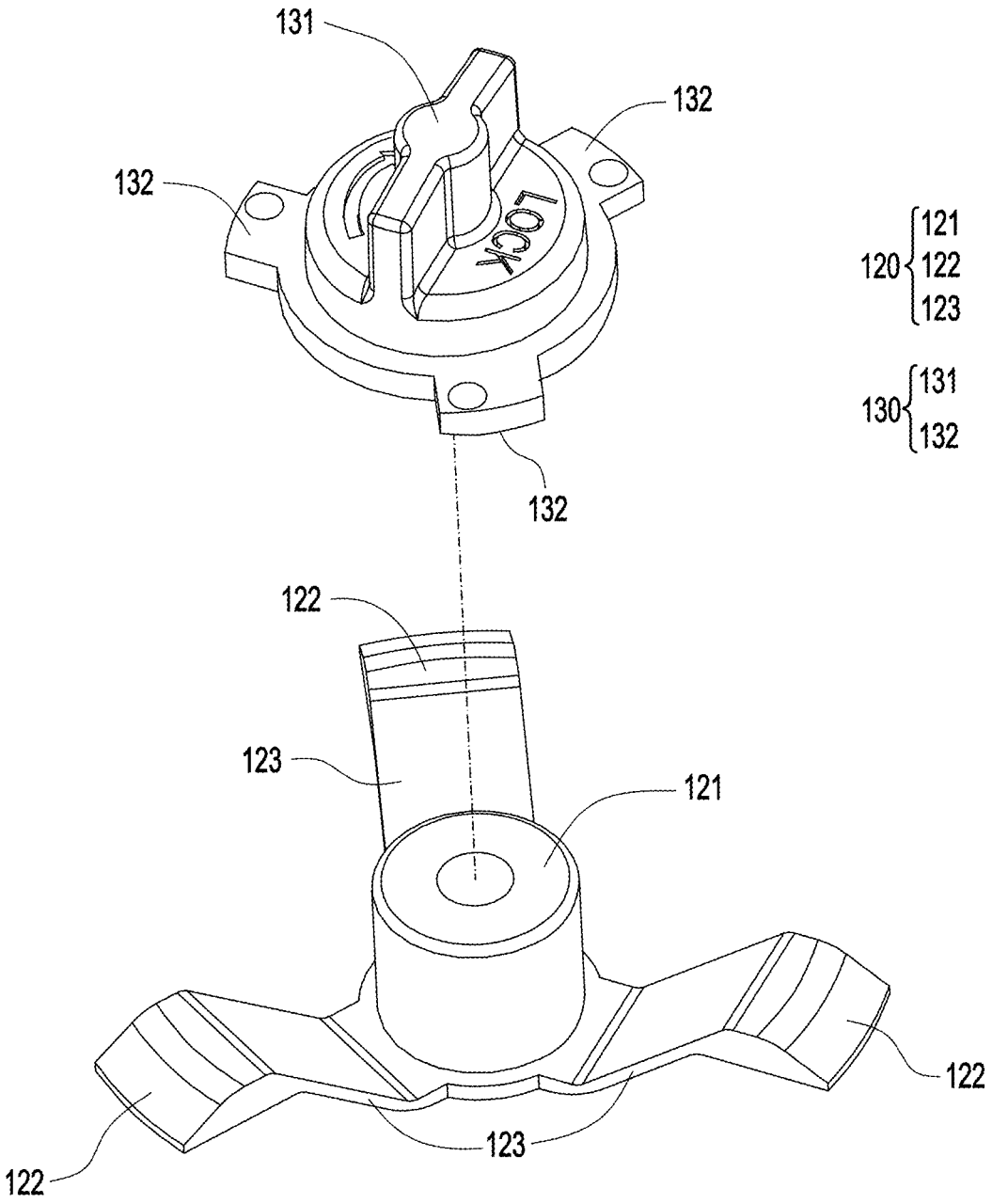
FIG. 4B to FIG. 4D are enlarged schematic views of some components of FIG. 4A.
Figure 4C:
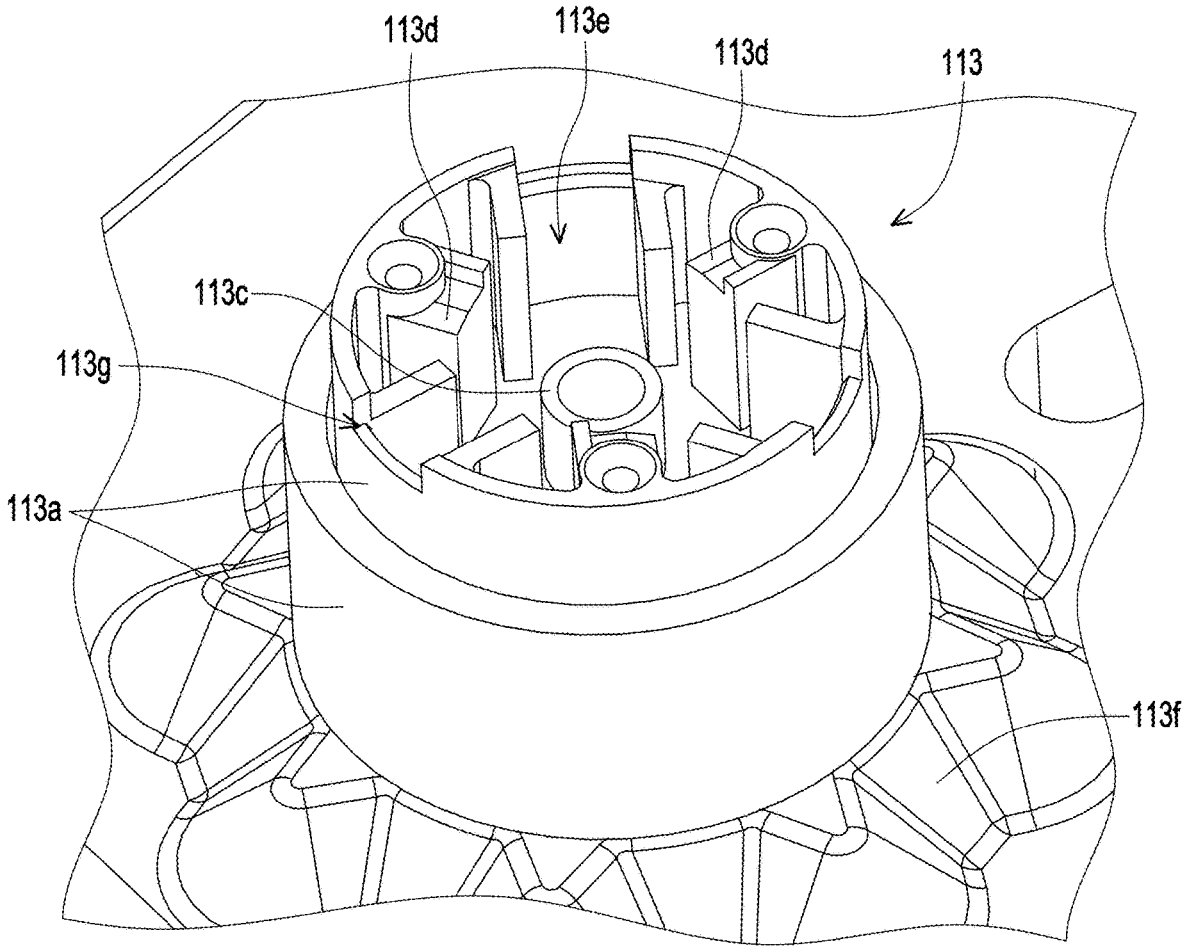
Figure 4D:
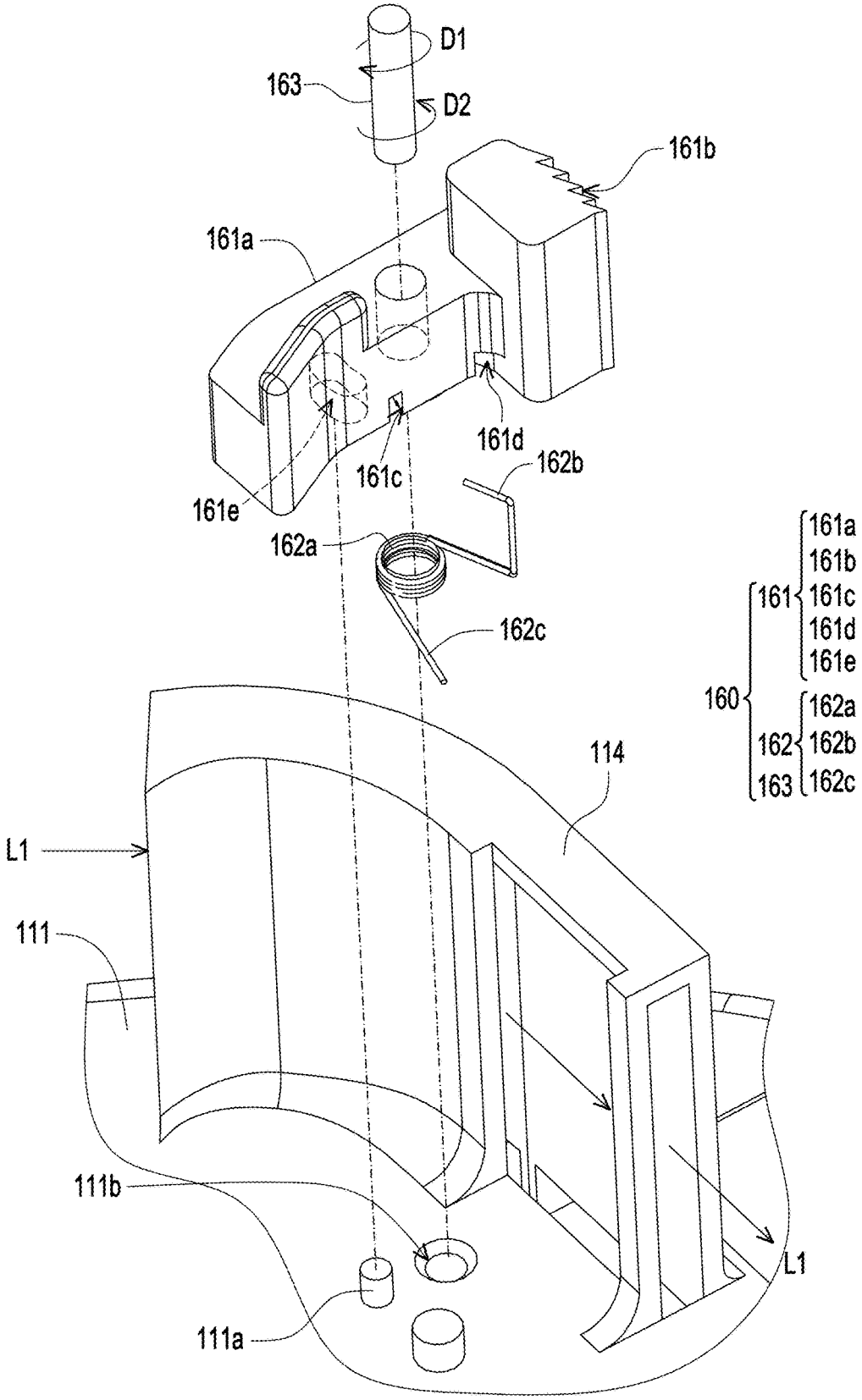

FIG. 4B to FIG. 4D are enlarged schematic views of some components of FIG. 4A. Please refer to FIG. 4A to FIG. 4C. Further, the protruding column 113 of this embodiment has a top portion 113*b* and an inner column 113*c* and an outer column 113*a* coaxially disposed with respect to an axis CX. The roll portion 210 is sleeved onto the outer column 113*a*. The outer column 113*a* covers the inner column 113*c*. The movable claw 120 has a sleeve 121 and an elastic arm 123. The sleeve 121 is coaxially disposed with respect to the axis CX and movably sleeved onto the inner column 113*c*. The elastic arm 123 extends from the sleeve 121. The claw hook 122 is located at a distal end of the elastic arm 123 away from the sleeve 121. The button 130 is coaxially borne on the sleeve 121 with respect to the axis (CX). Furthermore, the outer column 113*a* has a receiving groove 113*e* facing the inner column 113*c*. The protrusion column 113 has a stopper block 113*d* located between the inner column 113*c* and the outer column 113*a* and misaligned with the receiving groove 113*e*. The elastic arm 123 of the movable claw 120 is located in the receiving groove 113*e*. The spring 150 is disposed in the inner column 113*c* and abuts between a bottom surface of the inner column 113*c* and the sleeve 121. Here, the elastic force of the spring 150 constantly drives the movable claw 120 to lift in the protruding column 113, that is, to drive the movable claw 120 and the button 130 thereon away from the bottom surface of the inner column 113*c*.

Figure 5A:
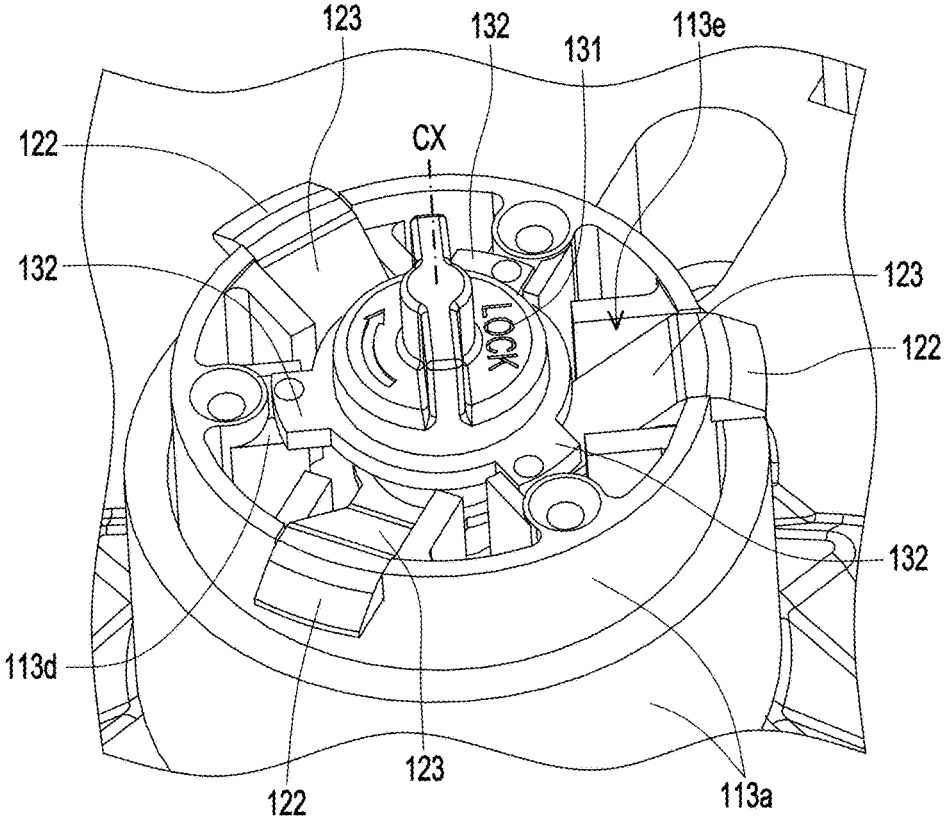
FIG. 5A and FIG. 5B illustrate partial schematic views of the portable hook and loop strip dispenser.
Figure 5B:
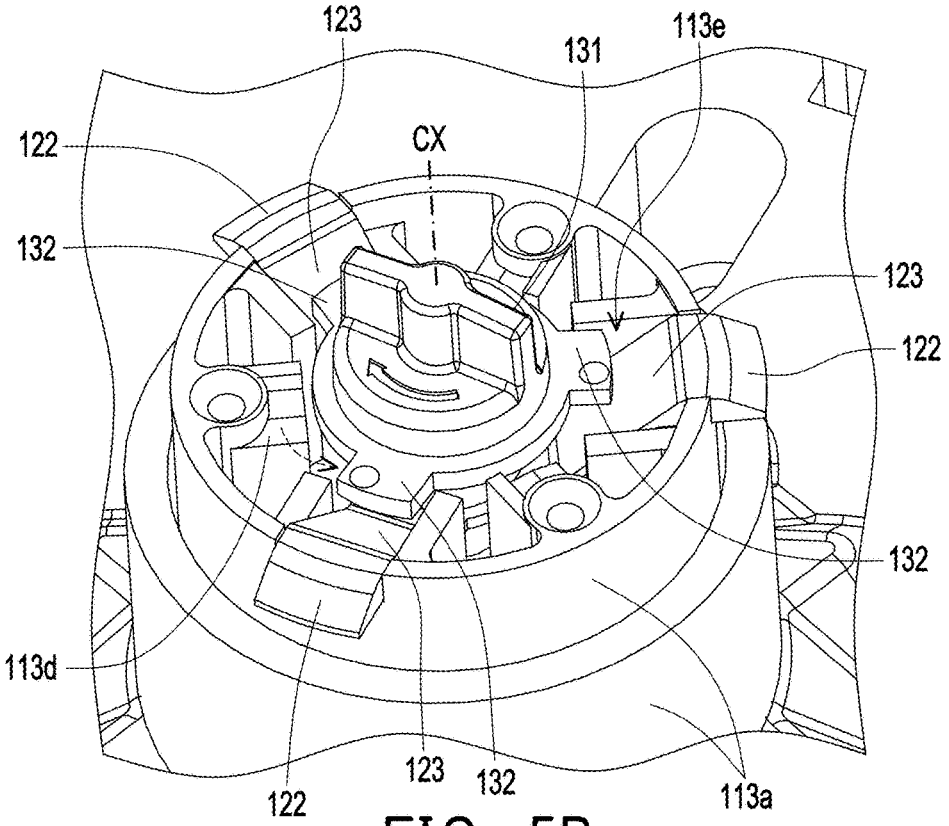

FIG. 5A and FIG. 5B illustrate partial schematic views of the portable hook and loop strip dispenser. Please refer to FIG. 5A and FIG. 5B at the same time, and compare with FIG. 4B. In this embodiment, the button 130 is rotatably and liftably disposed on the protrusion column 113 and borne on the movable claw 120, in which the button 130 is in a locked state (FIG. 5A) or an unlocked state (FIG. 5B) due to the rotation. In detail, the button 130 has a pressing portion 131 and a stopping portion 132. The stopping portion 132 radially extends from the periphery of the pressing portion 131. The pressing portion 131 passes through and protrudes from the top portion 113*b* of the outer column 113*a*.

Figure 6A:
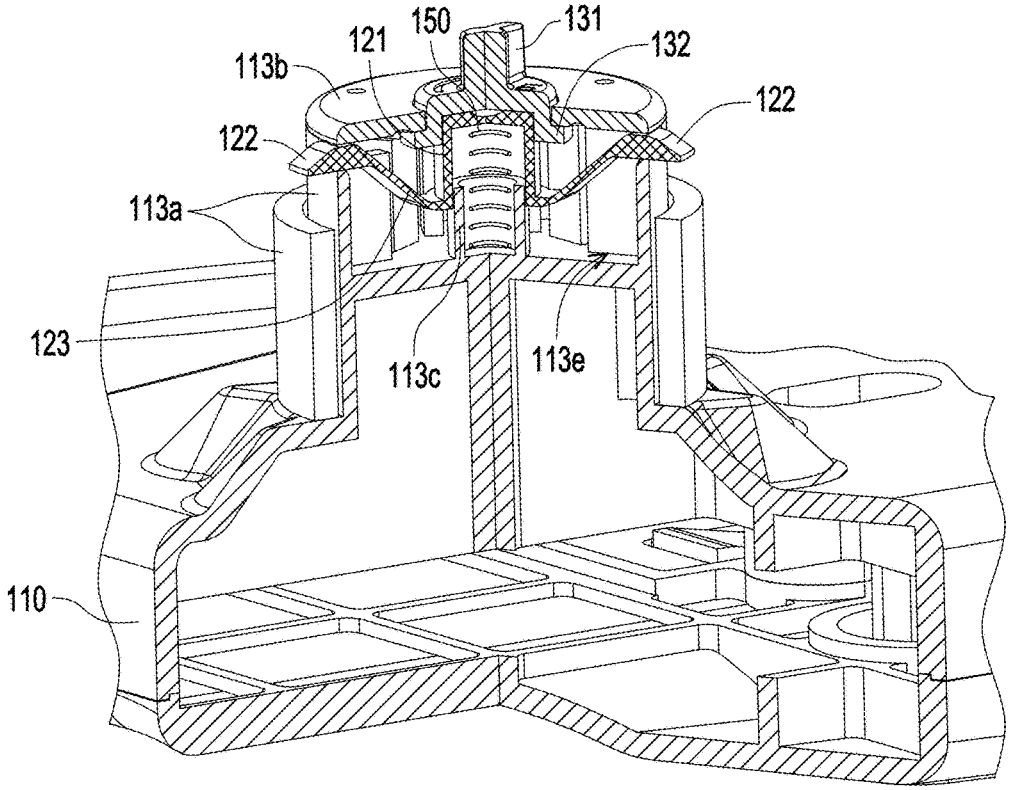
FIG. 6A and FIG. 6B illustrate partial cross-sectional views of the portable hook and loop strip dispenser.
Figure 6B:
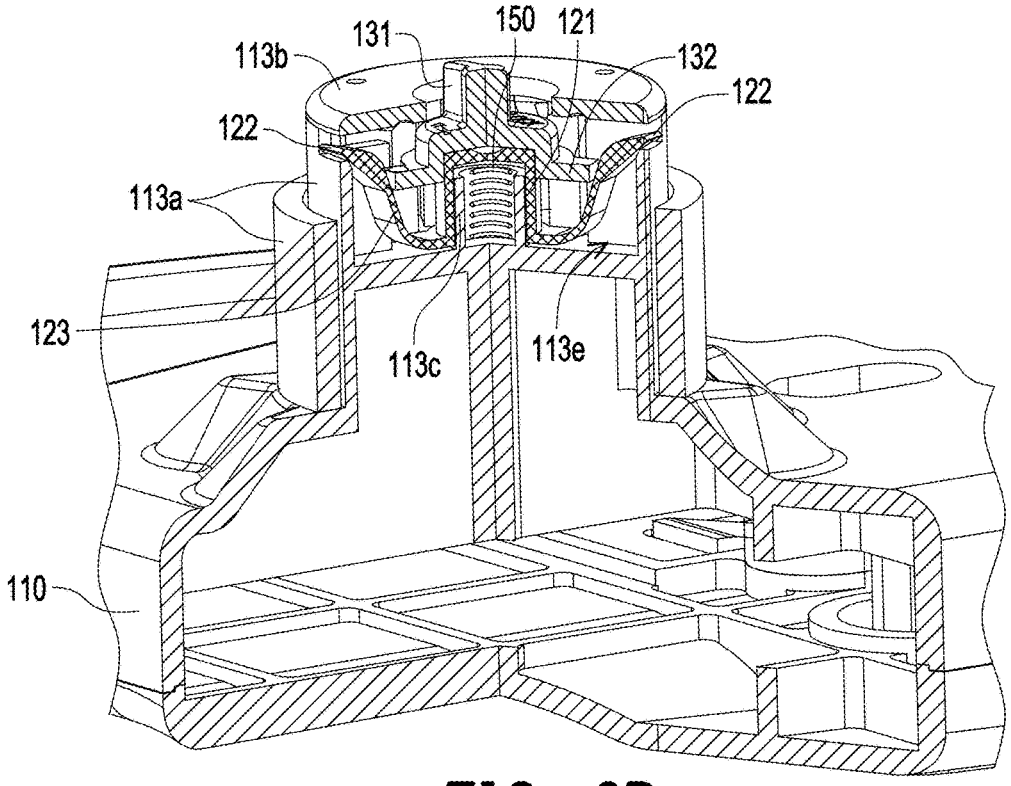

FIG. 6A and FIG. 6B illustrate partial cross-sectional views of the portable hook and loop strip dispenser. Please refer to FIG. 5A and FIG. 6A. The button 130 shown in the two drawings is in the locked state. At this time, the movable claw 120 is driven by the spring 150 to abut upward, that is, the movable claw 120 is driven and the button 130 is linked to the movement to lift in the protrusion column 113. Therefore, the stopping portion 132 of the button 130 abuts against the top portion 113*b* of the outer column 113*a*, thereby the button 130 is prevented from falling off from the protrusion column 113. At the same time, it should be noted that, at this time the stopper block 113*d* is located on a lowering path of the stopping portion 132. Therefore, even if force is applied to the pressing portion 131 to press down, the pressing operation cannot be performed due to the presence of the stopper block 113*d*, so as to ensure and maintain the locked state. In addition, at this time, the claw hook 122 of the movable claw 120 protrudes from the column surface of the outer column 113*a*. Therefore, when the roll portion 210 is sleeved onto the protrusion column 113 as shown in FIG. 3, the claw hook 122 may smoothly hold and fix the roll portion 210 on the protrusion column 113 and the base 110.

Next, please refer to FIG. 5B and FIG. 6B. The button in the two drawings is rotated and moved away from the stopper block 113*d* (for example, as shown by a dotted arrow in FIG. 5B, at this time, the stopping portion 132 moves to the receiving groove 113*e* and is located above the elastic arm 123), that is to say, the stopper block 113*d* is no longer on the lowering path of the stopping portion 132. Therefore, at this time, when a user applies force to the pressing portion 131, the button 130 may be smoothly driven to lower, the sleeve 121 of the movable claw 120 is also linked to the movement to lower along the inner column 113*c* at the same time, and the spring 150 is deformed at the same time. As mentioned above, the sleeve 121 and the claw hook 122 are connected by the elastic arm 123. Therefore, as the sleeve 121 lowers, the elastic arm 123 folds and deforms toward the sleeve 121, thereby driving the claw hook 122 to retract into the outer column 113*a*. Therefore, the roll portion 210 held by the outer column 113*a* as mentioned above may be released, which allows the user to take the roll portion 210 out from the dispenser 100.

Correspondingly, when the user stops applying force to the button 130, the elastic force generated by the deformation of the spring 150 may smoothly drive the movable claw 120 and the button 130 to reset and return to the state shown in FIG. 6A from the state shown in FIG. 6B. At this time, if the roll portion 210 is sleeved on the outer column 113*a*, then the roll portion 210 is held by the claw hook 122 again. At the same time, the user may rotate the button 130 again to return the button 130 from the unlocked state shown in FIG. 5B to the locked state shown in FIG. 5A to facilitate firm placement of the hook and loop strip 200 on the dispenser 100.

Please refer to FIG. 3, FIG. 4A, and FIG. 4D at the same time. In this embodiment, the dispenser 100 further includes a latch assembly 160, the base 110 further has a turning wall 114, and the latch assembly 160 is disposed next to the turning wall 114. A ribbon portion 220 of the hook and loop strip 200 passes through the turning wall 114 along a path L1 and turns after extending from the roll portion 210. Furthermore, the latch assembly 160 has one-way teeth 161*b*, and the one-way teeth 161*b* are along the path L1, so that the ribbon portion 220 may be temporarily fixed by the one-way teeth 161*b* when passing through the turning wall 114.

Furthermore, the latch assembly 160 includes a latch member 161, a torsion spring 162, and a pivot shaft 163. The latch member 161 is freely pivoted on the base 110 through the pivot shaft 163 to facilitate pivoting rotation around a direction one D1 or a direction two D2. The latch member 161 is generally in the shape of a mallet and has the one-way teeth 161*b* on a head portion of the mallet. In addition to allowing the pivot shaft 163 to be disposed and placed in a pivot hole 111*b*, a handle portion of the latch member 161 further has a guiding groove 161*e*, and the base 110 has a guiding column 111*a* coupled to the guiding groove 161*e* to provide a guiding effect when the latch member 161 rotates with respect to the base 110.

Furthermore, the torsion spring 162 abuts between the base 110 and the latch member 161, and the torsion spring 162 constantly drives the latch member 161 to rotate in the direction two D2, in which the path L1 is a tangential direction of the direction one D1, and the direction one D1 and the direction two D2 are opposite to each other. Further, the torsion spring 162 includes a center 162*a* and two end portions 162*b* and 162*c*, in which the pivot shaft 163 passes through the center 162*a* and the center 162*a* is stored inside the bottom of the latch member 161, the end portion 162*b* extends from the center 162*a* and passes through an opening 161*d* of the handle portion and abuts against the head portion of the mallet, while the end portion 162*c* extends from the center 162*a* and passes through an opening 161*c* of the handle portion and abuts against the protrusion column of the base 110 (as shown in FIG. 4D, located on the lower right side of the guiding column 111*a*).

In this way, when the user applies force to pull the ribbon portion 220, the operation is equivalent to allow the ribbon portion 220 to move along the path L1, which is equivalent to pull the hook and loop strip 200 from the roll portion 210. Therefore, the latch member 161 may be linked to the movement along the path to pivot around the direction D1, and since being along the path, the ribbon portion 220 may smoothly pass through the one-way teeth 161*b*. At the same time, the latch member 161 pivoting around the direction one D1 deforms the torsion spring 162 at the same time. In contrast, when the user no longer applies the force to pull the ribbon portion 220 as mentioned above, the elastic force of the torsion spring 162 drives the latch member 161 to pivot around the direction two D2, and allow the one-way teeth 161*b* to temporarily hold the ribbon portion 220, so as to achieve a temporary fixed effect to the hook and loop strip 200 regarding the ribbon portion 220 pulled from the roll portion 210.

Figure 4E:
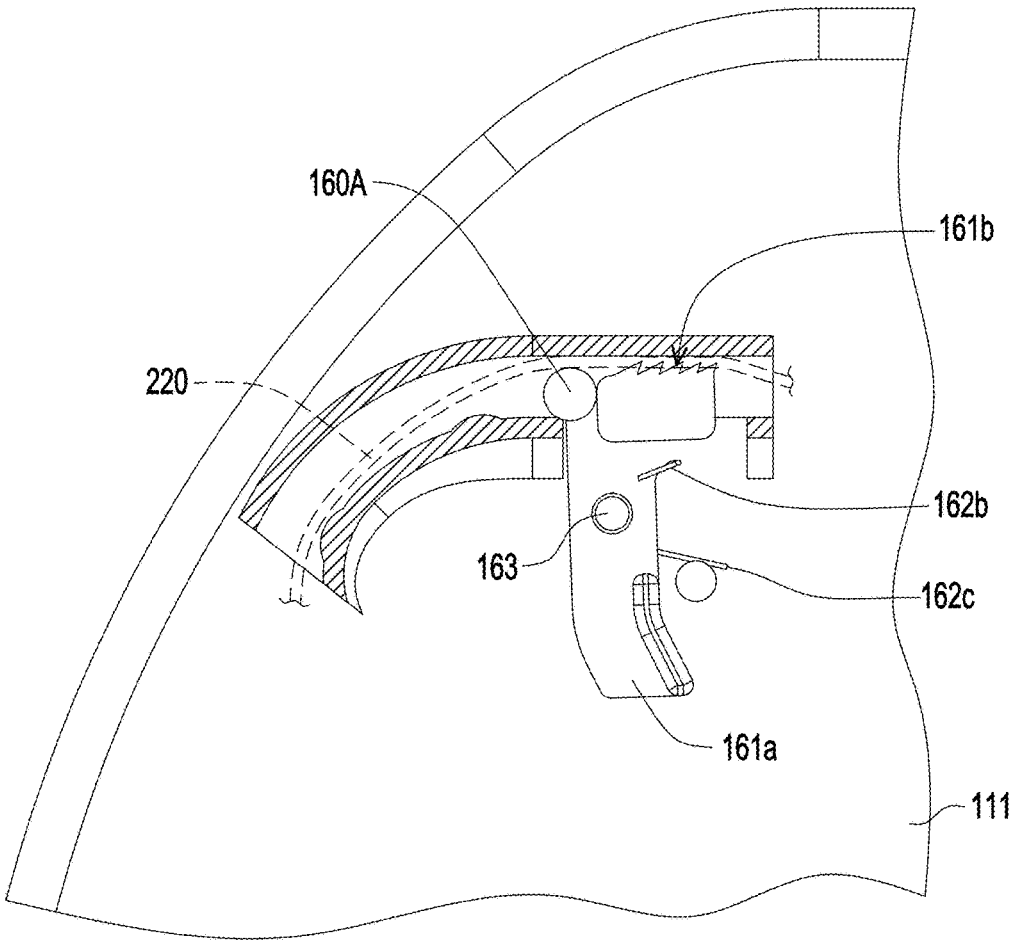
FIG. 4E is a partial schematic view of a dispenser according to another embodiment of the disclosure.
Figure 4F:
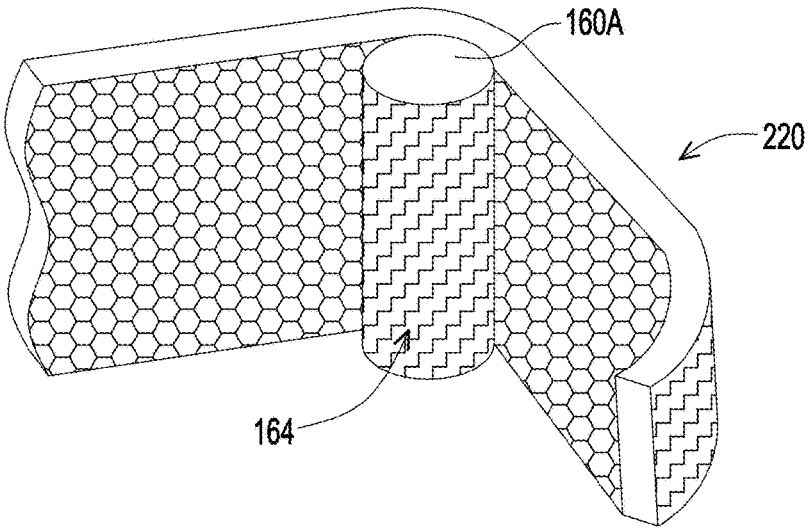
FIG. 4F is a schematic view corresponding to the damper wheel and the hook and loop strip of FIG. 4E.

In a well-known manner, the hook and loop strip 200 is a fiber fastener whose surface has hooks (also referred to as hook surface) and loops (also referred to as loop surface). FIG. 4E is a partial schematic view of a dispenser according to another embodiment of the disclosure. FIG. 4F is a corresponding schematic view of the damper wheel and the hook and loop strip of FIG. 4E. Please refer to FIG. 4E and FIG. 4F. In this embodiment, in addition to the same latch assembly 160 as the previous embodiments, the dispenser further includes a damper wheel 160A pivoted on the upper shell 111, and a column surface of the damper wheel 160A has a hook-like structure 164, so as to be correspondingly engaged with the loop-like structure of the hook and loop strip 200, so as to achieve the engaging effect produced by the one-way teeth 161*b*. In FIG. 4F, different cross-section patterns are used to represent the hook-like structure 164 and the loop-like structure. Similarly, if the hook-like structure 164 of the hook and loop strip 200 faces the damper wheel 160A, then the column surface of the damper wheel 160A is changed to the loop-like structure.

On the other hand, in other embodiments not shown, the damper wheel 160A may also replace the latch assembly 160, or the one-way teeth 161*b* of the latch assembly 160 may be replaced with the column surface of the damper wheel 160A, that is, the hook-like structure 164 or the loop-like structure is disposed on the head portion of the mallet of the latch member 161 to replace the one-way teeth 161*b*.

Figure 4G:
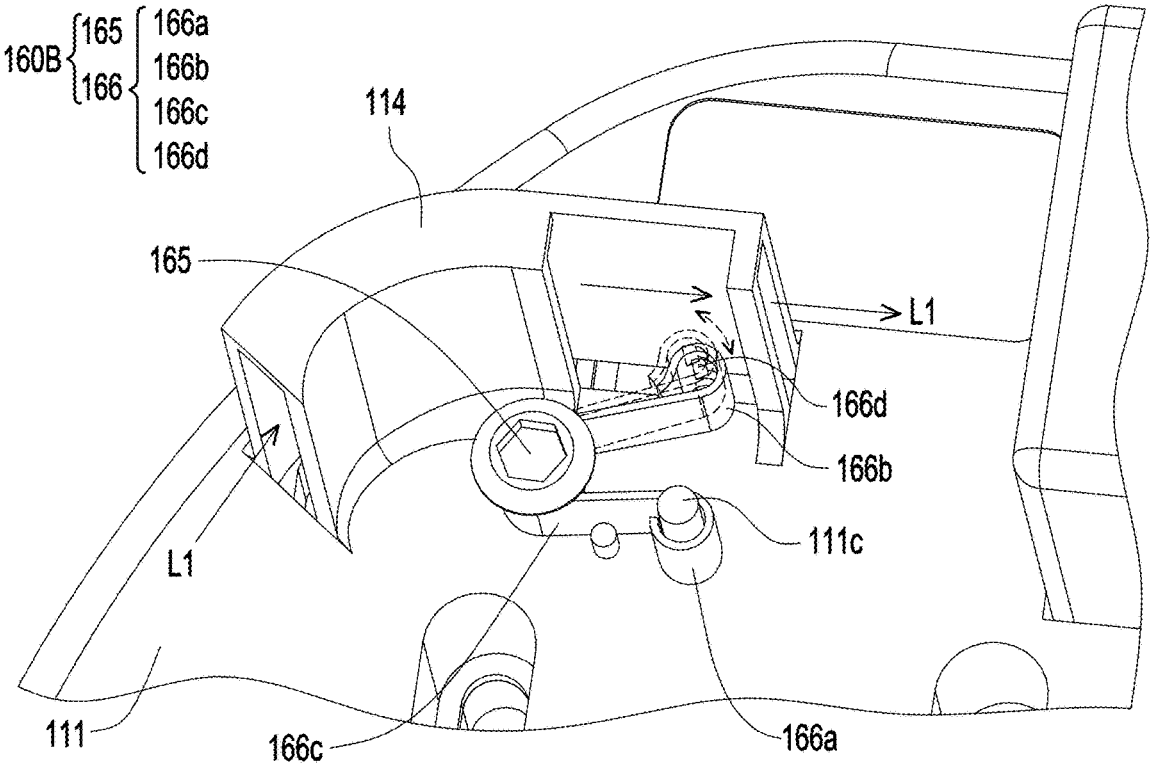
FIG. 4G is a partial schematic view of the dispenser according to another embodiment of the disclosure.
Figure 4H:
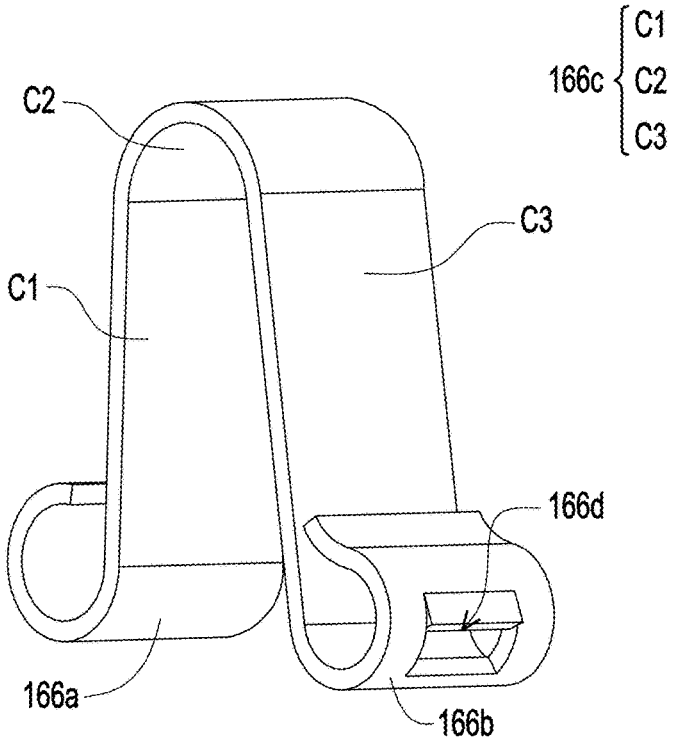
FIG. 4H is a schematic view of an elastic piece of FIG. 4G.

FIG. 4G is a partial schematic view of the dispenser according to another embodiment of the disclosure. FIG. 4H is a schematic view of an elastic piece of FIG. 4G. Please refer to FIG. 4G and FIG. 4H at the same time. Different from the previous embodiments, a latch assembly 160B of this embodiment includes a fixed shaft 165 and an elastic piece 166, in which the fixed shaft 165 is fixedly disposed on the upper shell 111, and the elastic piece 166 is in the shape of "Ω" and includes roll portions 166*a*, 166*b* and a bending portion 166*c*, the roll portion 166*a* is sleeved onto and fixed on a protrusion column 111*c* of the upper shell 111, and the bending portion 166*c* is sleeved onto the fixed shaft 165 and is limited by the fixed shaft 165. The bending portion 166*c* is further divided into segments C1, C2, C3, in which the segment C1 is connected to the roll portion 166*a*, the segment C3 is connected to the roll portion 166*b*, and the segment C2 abuts against the fixed shaft 165 and connected between the segments C1, C3.

Due to the fixation of the roll portion 166*a* and the abutting and limiting of the fixed shaft 165, the elastic piece 166 has a free end in the segment C3 and the roll portion 166*b* and has the characteristic of elastic deformation. More importantly, the elastic piece 166 further has a protrusion 166*d* located at the roll portion 166*b*, which corresponds to the hook and loop strip 200 (as shown in the previous embodiments) and provides an engaging force opposite to the path L1, so as to smoothly provide engagement for the hook and loop strip 200 and prevent from moving in an opposite direction (opposite to the path L1). Here, the protrusion 166*d* is formed by, for example, punching and bending the elastic piece 166 at the roll portion 166*b*, but the disclosure is not limited thereto.

Figure 7A:
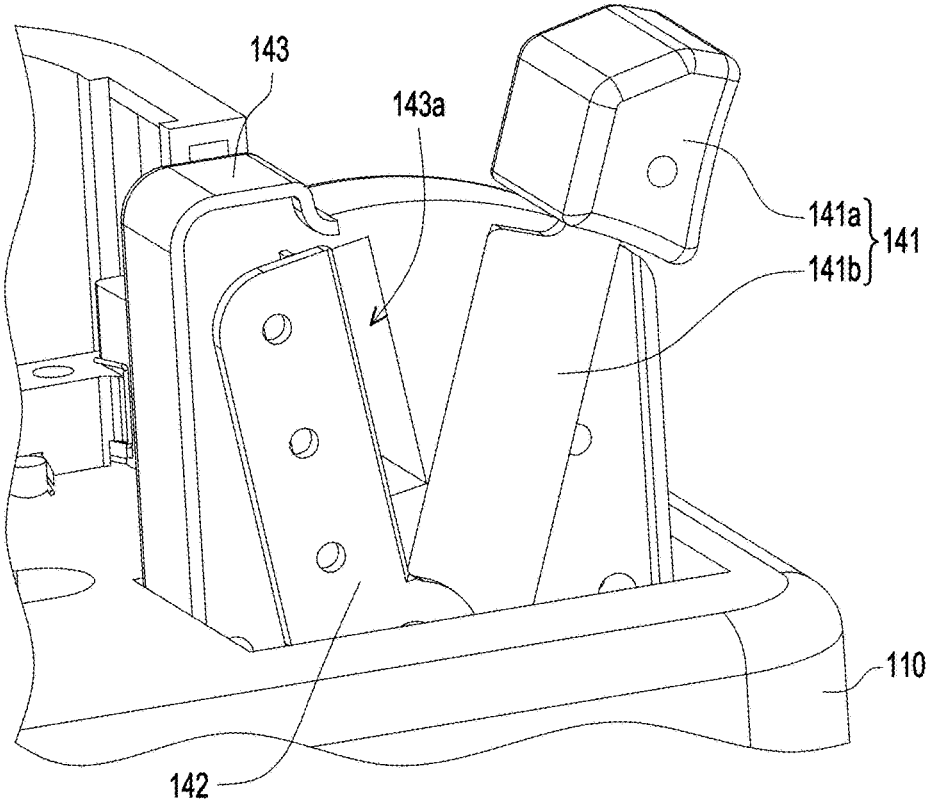
FIG. 7A and FIG. 7B are partial schematic views of the portable hook and loop strip dispenser.
Figure 7B:
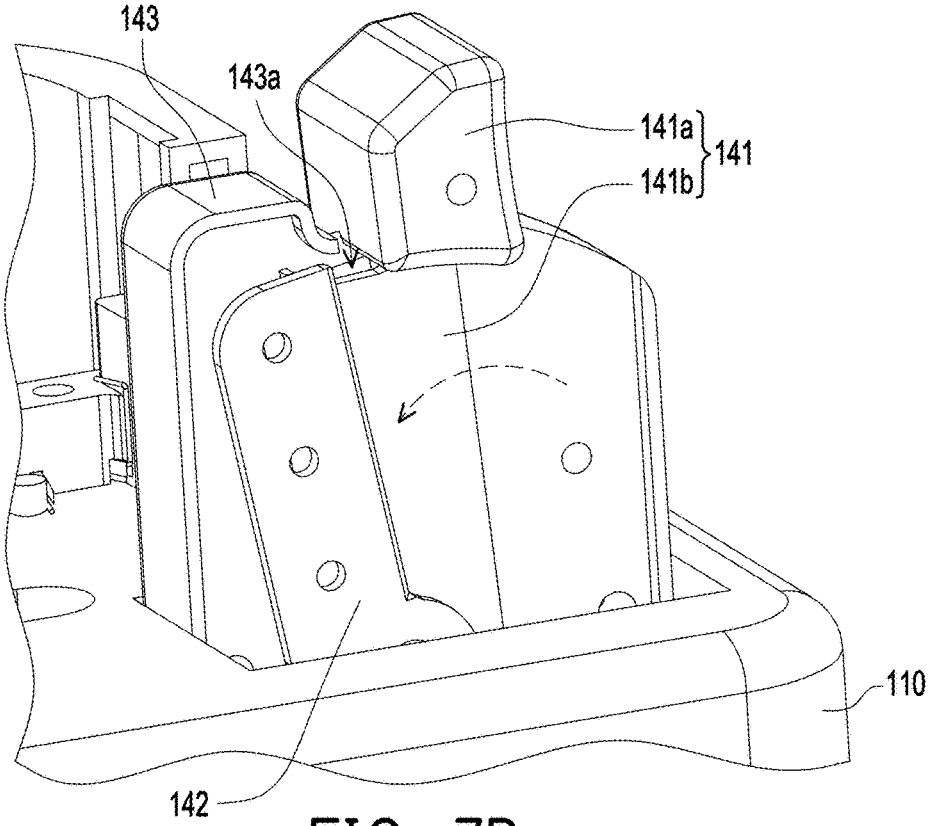

FIG. 7A and FIG. 7B are partial schematic views of the portable hook and loop strip dispenser. Please refer to FIG. 4A, FIG. 7A, and FIG. 7B at the same time. The dispenser 100 further includes a cutting assembly 140, the ribbon portion 220 of the hook and loop strip 200 passes through the turning wall 114 along the path L1 and turns and then goes to the cutting assembly 140 after pulling out and extending from the roll portion 210, so that the user may cut the ribbon portion 220 through the cutting assembly 140. Furthermore, the cutting assembly 140 includes holders 143, 144 and cutting blades 141, 142 movably disposed in the holders 143, 144, in which the cutting blade 142 fixed in the holders 143, 144 and the other cutting blade 141 movably disposed in the holders 143, 144 are included, in which a blade 141*b* is penetrated by a pivot shaft 145 so that the ribbon portion 220 may be cut by the cutting blades 141, 142 when passing through the holders 143, 144. In this embodiment, the cutting blade 141 includes the blade 141*b* and a handle 141*a*, in which the blade 141*b* is pivotally connected to the cutting blade 142 through the pivot shaft 145, and the handle 141*a* is exposed outside the holders 143, 144 to facilitate operation for the user.

Please refer to FIG. 2 and FIG. 4A again. In this embodiment, the dispenser 100 further includes a back clip 170 and a magnet 180 disposed on the base 110 and facing away from the protrusion column 113, in which the back clip 170 has an engaging interface 173 and clip pieces 171, 172. The engaging interface 173 is installed on an engaging block 112*a* of the lower shell 112, and due to the assembly of the upper shell 111 and the lower shell 112, part of the clip piece 171 is clamped therein to complete the assembly of the back clip 170 and the base 110. As shown in FIG. 2, the portion of the back clip 170 exposed from the base 110 allows the user to wear the dispenser 100 on the body or clothing, thereby portable carrying the hook and loop strip 200 is facilitated. Similarly, the magnet 180 is also used to allow the base 110 to be attached or fixed on an object having magnetic permeability, and can also provide convenience during operation of the dispenser 100.

On the other hand, the base 110 of this embodiment further has a holding portion 115, which is helpful for the user to hold the base 110 firmly during operation, and also improves the convenience of the dispenser 100.

In summary, in the above-mentioned embodiments of the disclosure, the dispenser is disposed with the protrusion column on the base thereof that can accommodate the roll portion of the hook and loop strip, and is disposed with the movable claw, the button, and the spring on the protrusion column together. Accordingly, the protrusion column may not only be used for the roll portion to be sleeved thereon, but also can stop, hold, or release the roll portion through the claw hook of the movable claw, so that when the roll portion is held by the claw hook, the hook and loop strip is firmly disposed on the base and does not fall from the dispenser during portable carrying of the user.

The button is rotatably and liftably disposed on the protrusion column, so with the stopper block on the protrusion column, the button may be switched between the locked state and the unlocked state due to rotation. In the unlocked state, the stopper block moves away from the lowering path of the button, so that the button is pressed and drives the movable claw. Then, the claw hook of the movable claw is connected to the sleeve through the elastic arm, so when the button drives the sleeve to lower, the elastic arm deforms and folds toward the sleeve to facilitate driving the claw hook to retract into the protrusion column. In contrast, when the sleeve lifts, then it means that the elastic arm may expand with respect to the sleeve and allow the claw hook to be exposed from the column surface of the protrusion column again.

Furthermore, after the roll portion is sleeved on the protrusion column, the user may pull the ribbon portion from the roll portion and at the same time cut the ribbon portion through the cutting assembly at the cutting place after passing through the turning wall. Simply put, the dispenser provides carrying and cutting functions for the hook and loop strip accordingly, which facilitates operation for the user. Regarding the ribbon portion passing through the turning wall, the disclosure may also be temporarily fix the ribbon portion through the latch assembly to facilitate subsequent cutting of the ribbon portion. In addition, the dispenser is further disposed with the holding portion, the back clip, and the magnetic on the base, which not only facilitates operation for the user, but also provides portability.

What is claimed is:

1. A portable hook and loop strip dispenser, comprising:

a base having a protrusion column and a stopper block disposed in the protrusion column, wherein a roll portion of a hook and loop strip is sleeved onto the protrusion column;

a movable claw disposed in the protrusion column and movable in an axial direction of the protrusion column between an upper position and a lower position, wherein a claw hook of the movable claw is configured to be extended out of the protrusion column or retracted into the protrusion column along with movement of the movable claw in the protrusion column;

a button rotatably and axially movably supported on the protrusion column and borne on the movable claw, wherein the button is rotatable relative to the protrusion column between a locked rotational position and an unlocked rotational position; and a spring having two ends respectively abutting against the protrusion column and the movable claw, wherein the spring biases the movable claw toward the upper position, wherein in the locked rotational position, the stopper block is located in a downward movement path of the button, the claw hook of the movable claw is configured to be extended out of the protrusion column to stop and limit the roll portion at the protrusion column, and the movable claw is biased by the spring to abut the button against the protrusion column, wherein in the unlocked rotational position, the stopper block is outside the downward movement path of the button, the button is configured to be pressed to drive the movable claw to move downwardly in the protrusion column to deform the spring, and the claw hook of the movable claw is configured to be retracted into the protrusion column to release the roll portion.

2. The portable hook and loop strip dispenser as claimed in claim 1, wherein the protrusion column has an inner column and an outer column coaxially disposed with respect to an axis, the roll portion is sleeved onto the outer column, the outer column covers the inner column, the movable claw has a sleeve and an elastic arm, the sleeve is coaxially disposed with respect to the axis and movably sleeved onto the inner column, the elastic arm extends from the sleeve, the claw hook is located at-an a distal end of the elastic arm away from the sleeve, the button is coaxially borne on the sleeve with respect to the axis, in the locked rotational position, the claw hook extends from a column surface of the outer column, in the unlocked rotational position, the button drives the sleeve to lower with respect to the inner column, and the elastic arm folds and deforms toward the sleeve as the sleeve lowers and drives the claw hook to retract into the column surface of the outer column.

3. The portable hook and loop strip dispenser as claimed in claim 2, wherein the button has a pressing portion and a stopping portion, the stopping portion radially extends from a periphery of the pressing portion, the pressing portion passes through and protrudes from a top portion of the outer column, in the unlocked rotational position, the pressing portion is configured to be forced to drive the sleeve to lower, in the locked rotational position, the movable claw is driven by the spring to abut upward, so that the stopping portion abuts against the top portion of the outer column, and the stopper block is located on a lowering path of the stopping portion.

4. The portable hook and loop strip dispenser as claimed in claim 3, wherein the outer column has a receiving groove facing the inner column, the stopper block is located between the inner column and the outer column and misaligned with the receiving groove, the elastic arm is located in the receiving groove, and in the unlocked rotational position, the stopping portion moves to the receiving groove.

5. The portable hook and loop strip dispenser as claimed in claim 2, wherein the spring is disposed in the inner column and abuts against the sleeve.

6. The portable hook and loop strip dispenser as claimed in claim 1, further comprising a latch assembly, wherein the base further has a turning wall, the latch assembly is disposed next to the turning wall, a ribbon portion of the hook and loop strip passes through the turning wall along a path and turns after extending from the roll portion, the latch assembly has one-way teeth, the one-way teeth are along the path, so that the ribbon portion is temporarily fixed by the one-way teeth when passing through the turning wall.

7. The portable hook and loop strip dispenser as claimed in claim 6, wherein the latch assembly comprises a latch member and a torsion spring, the latch member is pivoted on the base and has the one-way teeth, the torsion spring abuts between the base and the latch member, the torsion spring constantly drives the latch member to rotate in a direction two, the path is a tangential direction of a direction one, and the direction one and the direction two are opposite to each other.

8. The portable hook and loop strip dispenser as claimed in claim 1, further comprising a cutting assembly, wherein the base further has a turning wall, a ribbon portion of the hook and loop strip passes through the turning wall along a path and turns and then goes to the cutting assembly after extending from the roll portion, so as to cut the ribbon portion through the cutting assembly.

9. The portable hook and loop strip dispenser as claimed in claim 8, wherein the cutting assembly comprises a holder and two cutting blades disposed in the holder, wherein one of the cutting blades is fixed in the holder, and the other of the cutting blades is movably disposed in the holder, so that the ribbon portion bears cutting by the two cutting blades when passing through the holder.

10. The portable hook and loop strip dispenser as claimed in claim 1, further comprising a back clip or a magnet disposed on the base and facing away from the protrusion column.

* * * * *